US011376601B2

(12) United States Patent
Huo et al.

(10) Patent No.: US 11,376,601 B2
(45) Date of Patent: Jul. 5, 2022

(54) CRUSHING DEVICE FOR WASTE TIRE AND MULTI-FUNCTIONAL CRUSHER WITH CRUSHING DEVICE

(71) Applicants: Yun Huo, Henan (CN); Zhengqing Huo, Henan (CN)

(72) Inventors: Yun Huo, Henan (CN); Zhengqing Huo, Henan (CN)

( * ) Notice: Subject to any disclaimer, the term of this patent is extended or adjusted under 35 U.S.C. 154(b) by 214 days.

(21) Appl. No.: 16/988,649

(22) Filed: Aug. 8, 2020

(65) Prior Publication Data

US 2021/0023567 A1 Jan. 28, 2021

Related U.S. Application Data

(63) Continuation of application No. PCT/CN2019/098769, filed on Aug. 1, 2019.

(30) Foreign Application Priority Data

Jul. 8, 2019 (CN) ..... 201910610510.3

(51) Int. Cl.

| | |
|---|---|
| ***B02C 4/08*** | (2006.01) |
| ***B02C 4/12*** | (2006.01) |
| ***B02C 4/44*** | (2006.01) |

(52) U.S. Cl.

CPC ..... *B02C 4/08* (2013.01); *B02C 4/12* (2013.01); *B02C 4/44* (2013.01); *B02C 2201/04* (2013.01)

(58) Field of Classification Search

CPC .. B02C 4/30; B02C 4/305; B02C 4/20; B02C 4/44; B02C 4/12; B02C 4/08; B02C 18/14; B02C 18/18; B02C 18/145; B02C 2201/04

See application file for complete search history.

(56) References Cited

U.S. PATENT DOCUMENTS 1,019,612 A * 3/1912 Dowwd ..... B02C 2/10 241/294
1,318,950 A * 10/1919 Allison ..... B02C 2/10 241/294
1,674,911 A * 6/1928 McPhillips ..... D21D 1/02 241/294
2,781,176 A * 2/1957 Clark ..... B02C 18/186 241/294
3,339,258 A * 9/1967 Johnston ..... B21C 37/26 29/895.21

(Continued)

*Primary Examiner* — Faye Francis

(57) ABSTRACT

A crushing device for a waste tire and a multi-functional crusher therewith are provided. The crushing device includes a main shaft, a roll shaft main body fixedly arranged on the main shaft, and roll shaft blockers arranged at two axial ends of the main shaft; crushing components are arranged on the roll shaft main body; a plurality of roll shaft convex bodies are arranged on a periphery of the roll shaft main body along a circumferential direction; a roll shaft groove is formed between each two adjacent roll shaft convex bodies; the crushing components include tools, axial interval adjusting blocks and/or radial supporting blocks; a tool groove, corresponding to the roll shaft convex body, is provided at a bottom of each tool; and an axial interval adjusting block groove, corresponding to the roll shaft convex body, is provided on each axial interval adjusting block.

14 Claims, 7 Drawing Sheets

(56) References Cited

U.S. PATENT DOCUMENTS 4,219,291 A * 8/1980 Hoeh ..... B23P 15/28 76/115
4,560,112 A * 12/1985 Rouse ..... B23D 31/008 241/DIG. 31
4,650,127 A * 3/1987 Radwanski ..... D21B 1/066 241/222
4,848,683 A * 7/1989 Kawatsu ..... B02C 2/005 241/300
5,000,392 A * 3/1991 Kästingschäfer et al. ..... B02C 4/305 492/38
5,730,375 A * 3/1998 Cranfill ..... B02C 18/142 241/292.1
5,902,685 A * 5/1999 Schroder ..... B02C 4/305 428/167
7,159,809 B1 * 1/2007 Cheng ..... B02C 4/08 241/101.2
7,322,175 B2 * 1/2008 Ferre ..... A01D 82/02 56/16.4 B
7,980,278 B2 * 7/2011 Labbe ..... A01G 3/002 241/294
8,038,088 B2 * 10/2011 Pallmann ..... B05C 17/00576 241/294
8,061,640 B2 * 11/2011 Cotter ..... B02C 18/18 241/189.1
8,480,019 B1 * 7/2013 Scherer ..... B02C 4/08 241/293
2001/0040198 A1 * 11/2001 Rossler ..... B02C 18/145 241/294
2001/0045478 A1 * 11/2001 Recker ..... B02C 18/145 241/294
2006/0016923 A1 * 1/2006 Lee ..... B26D 7/2614 241/294
2006/0070569 A1 * 4/2006 Andrejewski ..... C30B 29/06 117/13
2007/0251601 A1 * 11/2007 Stager ..... B29B 17/0412 144/373
2008/0191074 A1 * 8/2008 Hagedorn ..... B02C 4/305 148/540
2008/0317933 A1 * 12/2008 Williamson ..... A23L 19/01 241/141
2009/0294558 A1 * 12/2009 Bihn ..... B02C 4/08 241/236
2010/0189519 A1 * 7/2010 Kerf ..... B02C 18/186 407/51
2011/0248550 A1 * 10/2011 Knotts ..... B02C 4/08 299/105
2013/0026273 A1 * 1/2013 Bihn ..... B02C 4/38 241/230
2014/0117133 A1 * 5/2014 Emmerich ..... B02C 4/20 241/291
2015/0102143 A1 * 4/2015 Bynelius ..... B02C 4/286 241/242
2015/0136884 A1 * 5/2015 Hoefter ..... B30B 11/165 492/46
2016/0263580 A1 * 9/2016 Rhea ..... B02C 4/30
2016/0303571 A1 * 10/2016 Petack ..... B02C 4/305
2016/0367994 A1 * 12/2016 Birtch ..... B02C 4/305
2017/0079219 A1 * 3/2017 Stanley ..... B02C 18/184
2018/0116117 A1 * 5/2018 Lutz ..... B02C 4/08
2019/0240861 A1 * 8/2019 Daining ..... B02C 18/18
2019/0283035 A1 * 9/2019 Fischer ..... B02C 13/2804
2020/0197947 A1 * 6/2020 Verzilli ..... B02C 13/2804

* cited by examiner

CRUSHING DEVICE FOR WASTE TIRE AND MULTI-FUNCTIONAL CRUSHER WITH CRUSHING DEVICE

CROSS REFERENCE OF RELATED APPLICATION

The application is a continuation application of a PCT application No. PCT/CN2019/098769, filed on Aug. 1, 2019; and claims the priority of Chinese Patent Application CN 201910610510.3, filed to the State Intellectual Property Office of China (SIPO) on Jul. 8, 2019, the entire content of which are incorporated hereby by reference.

BACKGROUND OF THE PRESENT INVENTION

Field of Invention

The present invention relates to a technical field of crushing equipment, and more particularly to a crushing device for a waste tire and a multi-functional crusher with the crushing device.

Description of Related Arts

With the global industrialization process and the rapid development of the automobile industry, the auto tires have also increased dramatically as an essential component, followed by recycling of waste tires. Crusher is an indispensable equipment in the recycling process of the waste tires. Conventional crushers process the waste tires with a strip cutting device, and then crush the cut strips with a crushing device. The strip cutting device and the crushing device generally adopt fixedly installed tooth rollers, which cannot control the width of the tire strips. And it is difficult to repair and maintain the crusher.

In addition, in other treatments of the waste tires, such as freezing and oil refining, there are problems such as high treatment cost and secondary pollution.

Chinese patent (CN 109664439 A) disclosed "a resource recovery system", comprising a machine body, a cutting device, a crushing device, and a filter, wherein a top part of the machine body is provided with a feed hopper; the cutting device is arranged in a cutting cavity of the machine body, and the crushing device is arranged in a crushing cavity of the machine body; the filter is arranged in a receiving cavity of the machine body, and is located below the crushing device. The device was designed to crush the waste tires and improve resource utilization. However, in practice, the device is difficult to inspect and repair, and it is impossible to control the width of the cut strips of the tires.

Chinese patent (CN 107127910 B) disclosed "a crusher for recycling tire rubber", comprising a cutting mechanism with a pair of engaged tooth rollers, a barrel, and a cutting roller, wherein a material barrel is located above the cutting roller; a cutter is distributed between the material barrel and the cutting roller, and the cutter is driven by a driving mechanism; the cutting mechanism is located below the cutting roller. The device takes advantages of the cutter which cuts the tires and the tooth rollers which crush the rubber strips to avoid most of the dense textured structure, thereby reducing wear of the cutter and extending the service life. However, the device is difficult to inspect and repair, and has poor convenience.

SUMMARY OF THE PRESENT INVENTION

Aiming at the deficiencies in the prior art, the present invention provides a crushing device for a waste tire and a multi-functional crusher with the crushing device, so as to improve convenience of part replacement of the multi-functional crusher and crushing efficiency of the waste tire, and decrease production costs of the crushing device and the multi-functional crusher.

In order to accomplish the above object, the present invention adopts technical solutions as follows.

A crushing device for a waste tire is provided, comprising a roll shaft and crushing components arranged on the roll shaft, wherein: the roll shaft comprises a main shaft, a roll shaft main body fixedly arranged on the main shaft, and roll shaft blockers arranged at two axial ends of the main shaft; a plurality of roll shaft convex bodies are arranged on a periphery of the roll shaft main body along a circumferential direction; and a roll shaft groove is formed between each two adjacent roll shaft convex bodies.

The crushing components comprise tools, axial interval adjusting blocks and/or radial supporting blocks, wherein: each tool consists of a tool base and a tool head which are fixedly connected; and a tool base groove, corresponding to the roll shaft convex body, is provided on the tool base. The tools are divided into cutting tools and grinding tools, wherein: the cutting tools are longer than the grinding tools; symmetrical cutting convex surfaces are arranged at a connection surface between a tool base and a tool head of each cutting tool; preferably, a top end of the tool head of each cutting tool is linear; a grinding convex surface is arranged at a side of a connection surface between a tool base and a tool head of each grinding tool along an axial direction of a grinding tool base groove; preferably, a top end of the tool head of each grinding tool is a curved surface.

Each radial supporting block consists of a supporting main body and a supporting base, wherein: a supporting groove, corresponding to the roll shaft convex body, is provided on the supporting base; a supporting convex surface is arranged at a side of a connection surface between the supporting main body and the supporting base along an axial direction of the supporting groove; and a top end of the supporting main body is a curved surface.

An axial interval adjusting block groove, corresponding to the roll shaft convex body, is provided on each axial interval adjusting block; the tools, the radial supporting blocks, and the axial interval adjusting blocks are slidably engaged with the roll shaft convex bodies; and the roll shaft fixes the roll shaft blockers and the crushing components through locking structures.

Preferably, the locking structures comprise a plurality of locking threaded holes provided on two end surfaces of the roll shaft main body, a plurality of locking through-holes which are provided on the roll shaft blockers and correspond to the plurality of locking threaded holes, and main shaft through-holes provided on the roll shaft blockers, through which the main shaft passes; and bolts pass through the locking through-holes and the locking threaded holes, so that the crushing components and the roll shaft blockers are locked and fixed.

A first multi-functional crusher is further provided, comprising a box, a recovery device and the crushing device, wherein: a material inlet and a material outlet are provided at an upper part of the box; the crushing device is arranged on a common frame body outside the box through the main shaft; the crushing device is driven through a drive mechanism and rotates around the main shaft.

The recovery device comprises a recovery component arranged inside the box and a recovery pushing mechanism arranged at the material outlet, wherein: the recovery pushing mechanism comprises a recovery pushing plate and a recovery pushing part arranged on the recovery pushing plate; the recovery pushing plate is slidably connected to a first side plate of the box at the material outlet; a discharge port, corresponding to the recovery pushing plate, is provided at an upper part of a front plate or a back plate of the box; the front plate and the back plate of the box are both detachably connected to the box.

The first multi-functional crusher further comprises a cooling medium mechanism, wherein: the cooling medium mechanism comprises a cooling medium through-hole, a reflux groove and a filtering cavity; the cooling medium through-hole is provided on the front plate or the back plate of the box; the reflux groove is provided on the front plate and/or the back plate of the box; the filtering cavity is arranged below a filtering top plate at the material outlet; a first end of the reflux groove is interconnected to the filtering cavity through a first through-hole, and a second end of the reflux groove is interconnected to a crushing cavity for placing the waste tire through a second through-hole; and the first through-hole and the second through-hole are both provided on a connection surface between the reflux groove and the front plate or the back plate of the box.

The recovery component comprises a lower axial blocker detachably connected to a bottom plate of the box, wherein: the lower axial blocker is engaged with the crushing components; the lower axial blocker and a first end of the material outlet are connected to a lower recovery plate.

The recovery component further comprises an upper axial blocker detachably connected to a top plate of the box, wherein: the upper axial blocker is engaged with the crushing components; the upper axial blocker and a second end of the material outlet are connected to an upper recovery plate.

The recovery component comprises the upper recovery plate and the lower recovery plate which are connected to the material outlet; the upper recovery plate and the lower recovery plate are both engaged with the crushing components.

Preferably, a crushing pushing mechanism and a material inlet cover mechanism are arranged on a second side plate of the box at the material inlet, wherein: the crushing pushing mechanism comprises a crushing pushing plate and a crushing pushing part arranged on the crushing pushing plate; the material inlet cover mechanism comprises a cover plate for covering the material inlet and a cover pushing part arranged on the cover plate; the crushing pushing plate and the cover plate are both slidably connected to the front plate and the back plate of the box.

A second multi-functional crusher is further provided, comprising a box, a recovery device and the crushing device, wherein: material inlets and a material outlet are provided at an upper part of the box; the crushing device is arranged on a common frame body outside the box through the main shaft; the recovery device is arranged above the crushing device, comprising a recovery box and a recovery pushing mechanism; the material outlet is provided at a middle part of a bottom surface of the recovery box; the material inlets are provided at two side plates of the recovery box; the recovery pushing mechanism comprises a recovery pushing plate and a recovery pushing part arranged on the recovery pushing plate; the recovery pushing plate is slidably connected to the side plates of the recovery box; and a discharge port, corresponding to the recovery pushing plate, is provided on a front plate or a back plate of the box.

Preferably, crushing pushing mechanisms and material inlet cover mechanisms are arranged on the both two side plates of the box; each crushing pushing mechanism comprises a crushing pushing seat and a crushing pushing part arranged on the crushing pushing seat; each material inlet cover mechanism comprises a cover plate and a cover pushing part arranged on the cover plate; the crushing pushing seats and the cover plates are all slidably connected to the front plate and the back plate of the box; and the crushing pushing seats are engaged with the crushing components.

Compared with the prior art, the present invention has beneficial effects as follows.

(1) Through adopting the crushing device which integrates the crushing components with the roll shaft, the usage and maintenance convenience of the crushing device are improved, the production cost is decreased, and the working efficiency is increased; meanwhile, through the flexible arrangement of the tools, the radial supporting blocks and the axial interval adjusting blocks with the roll shaft, the crushing device can be applied in different working conditions.

(2) Through adopting the multi-functional crusher with the crushing device, the production cost is decreased; the recovery device and the recovery pushing mechanism realize the automatic operation during the crushing process, so that the human cost and the operation cost are decreased; the usage of the cooling medium mechanism realizes the circulation of the cooling medium, so that the working temperature during the crushing process is decreased and the crusher is protected, thereby improving the working efficiency.

(3) The detachable connection of the front plate and the back plate of the box and the usage of the detachable axial blockers increase the check and maintenance efficiency of the crusher, so that the crushing device is unnecessary to be removed out of the box when checking and maintaining the crusher, which realizes the fast maintenance inside the box and saves time and labor.

(4) The locking threaded holes are provided in square around a center of the end surface of the roll shaft main body, so as to guarantee an overall stability of the crushing device.

DETAILED DESCRIPTION OF THE PREFERRED EMBODIMENT

The present invention is further illustrated with the preferred embodiments as follows. One skilled in the art can easily know the advantages and effects of the present invention from the disclosure of the specification. It should be known that: the structure, proportion and size shown in the figures are all only for matching the disclosure of the specification, so that one skilled in the art can know and read the technical solutions of the present invention, which are not for limiting the implementation of the present invention and do not have the substantive meaning in technology. Without influencing the generable effects and accomplishable objects of the present invention, any structural modification, change of the proportional relation, or the adjustment of the size should be all encompassed in the range of the technical solutions of the present invention. Meanwhile, the terms such as "up", "down", "left", "right", "front", "back", "middle" and "one" referred in the specification are only for clear description, not for limiting the implementable scope of the present invention. Without the substantive change of the technical solutions, the change or adjustment of the relative relation is also seen as the implementable scope of the present invention.

First Preferred Embodiment

According to the first preferred embodiment, as shown in FIGS. 1-7, the present invention provides a crushing device for a waste tire and a multi-functional crusher with the crushing device.

The crushing device 2 comprises a roll shaft and crushing components arranged on the roll shaft, wherein: the roll shaft comprises a main shaft 202, a roll shaft main body 201 fixedly arranged on the main shaft 202, and roll shaft blockers 203 and 208 arranged at two axial ends of the main shaft 202; and the roll shaft blockers 203 and 208 are detachably connected to the roll shaft main body 201 through locking structures.

Figure 1:
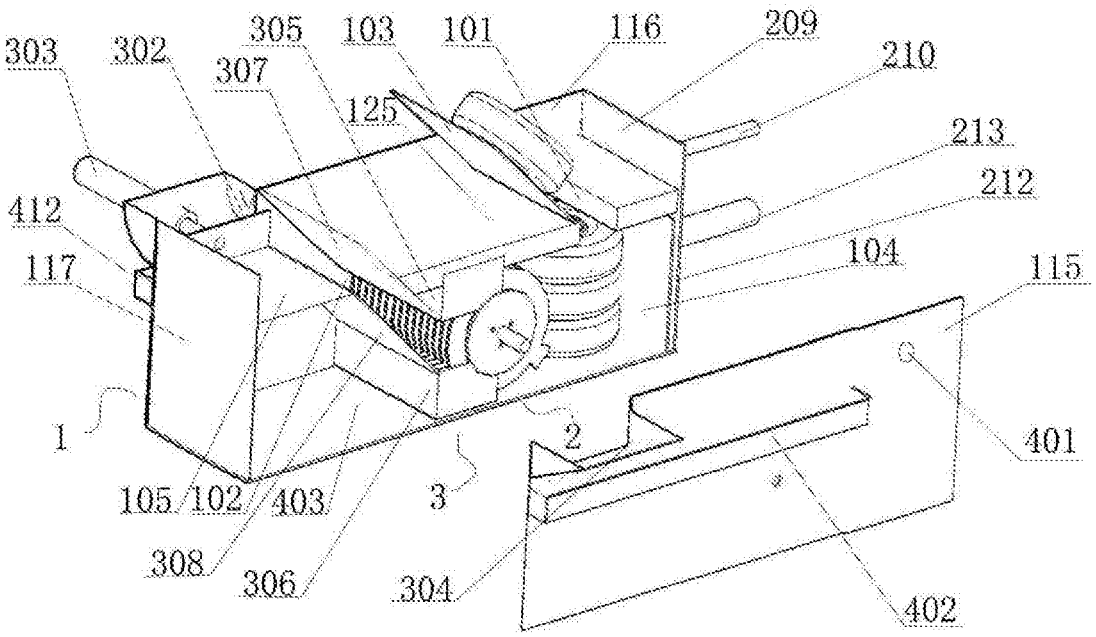
FIG. 1 is a structural sketch view of a multi-functional crusher according to a first preferred embodiment of the present invention.
Figure 2:
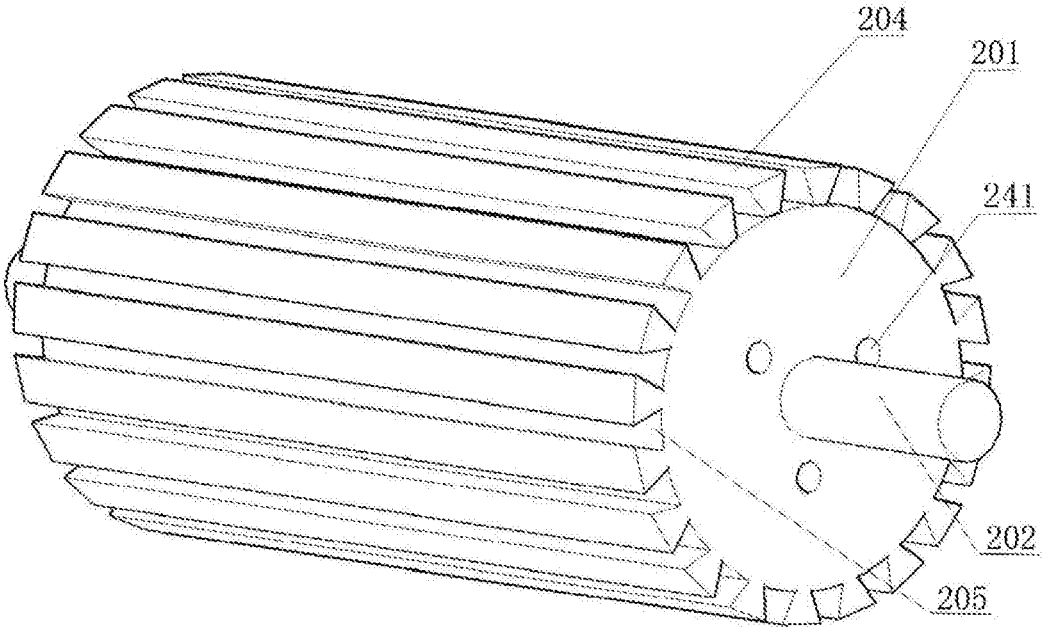
FIG. 2 is a structural sketch view of a roll shaft main body and a main shaft according to the first preferred embodiment of the present invention.

As shown in FIG. 2, a plurality of roll shaft convex bodies 204 are uniformly and fixedly arranged on a periphery of the roll shaft main body 201 along a circumferential direction; a roll shaft groove 205 is formed between each two adjacent roll shaft convex bodies 204; the roll shaft convex bodies 204 and the roll shaft grooves 205 are for arranging corresponding crushing components; the roll shaft convex bodies 204 can be in various shapes, such as being trapezoidal and cylindrical; in the first preferred embodiment, the trapezoidal roll shaft convex bodies 204 as an example are described in detail.

Figure 3:
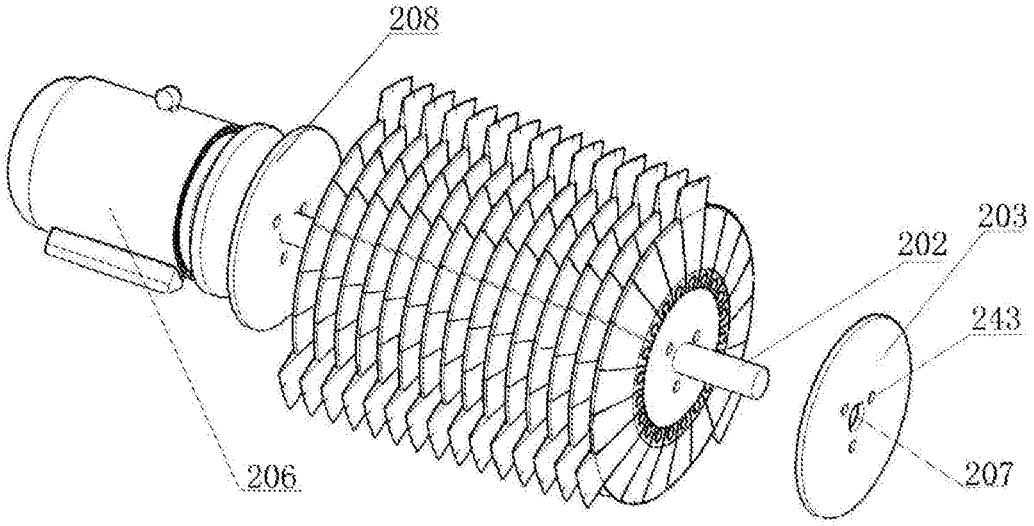
FIG. 3 is a structural sketch view of a crushing device according to the first preferred embodiment of the present invention.
Figure 4:
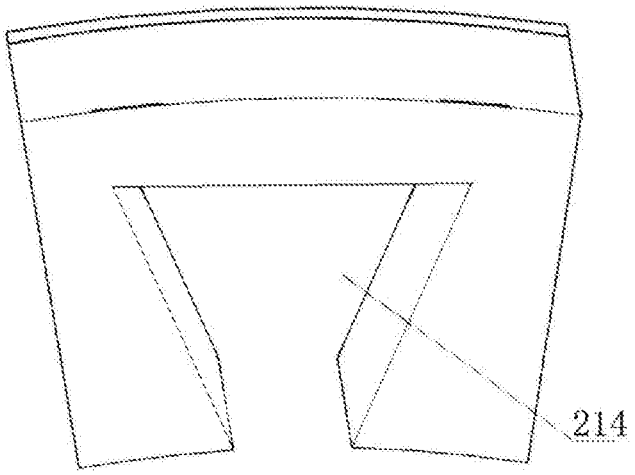
FIG. 4 is a structural sketch view of an axial interval adjusting block according to the first preferred embodiment of the present invention.
Figure 5:
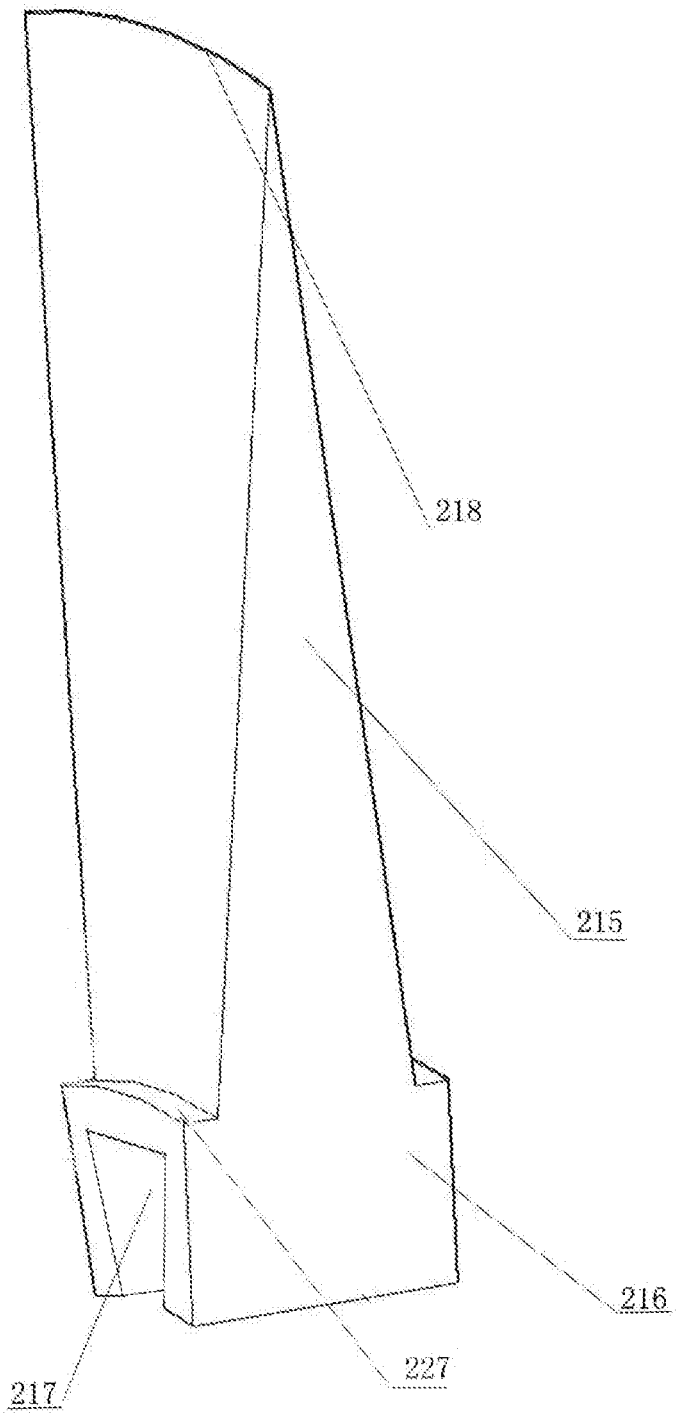
FIG. 5 is a structural sketch view of a cutting tool according to the first preferred embodiment of the present invention.
Figure 6:
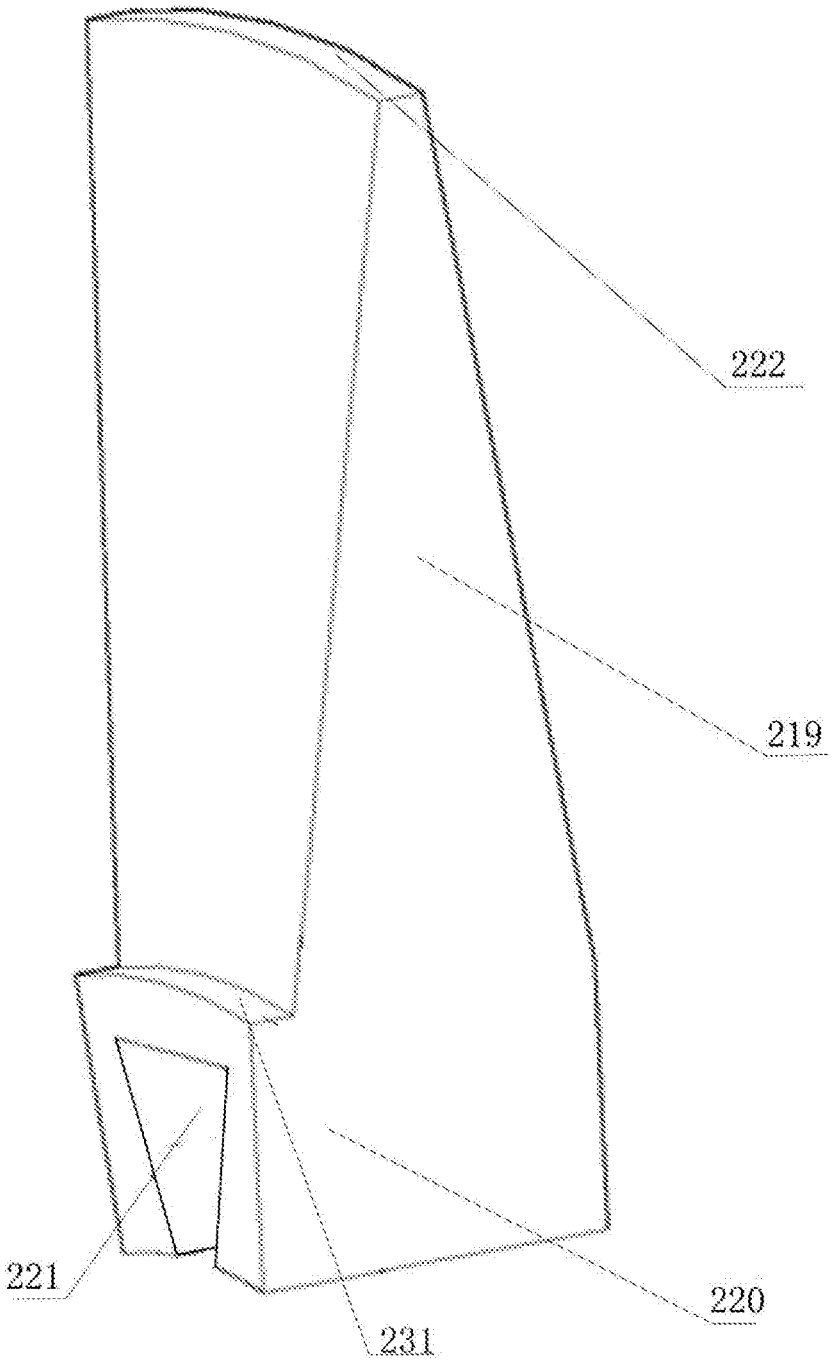
FIG. 6 is a structural sketch view of a grinding tool according to the first preferred embodiment of the present invention.

As shown in FIG. 3, two end surfaces of the roll shaft main body 201 have the same structure, and the roll shaft blockers 203 and 208 at the two end surfaces have the same structure. In the preferred embodiment, one side of the crushing device as an example is described in detail.

The roll shaft blocker 203 is circular; a radius of the roll shaft blocker 203 is larger than that of the end surfaces of the roll shaft main body 201; through the locking structures, the roll shaft blocker 203 is detachably connected to the roll shaft main body 201; the locking structures comprise a plurality of locking threaded holes 241 provided on the two end surfaces of the roll shaft main body 201, and a plurality of locking through-holes 243 corresponding to the plurality of locking threaded holes 241 on the end surfaces of the roll shaft main body and a main shaft through-hole 207 corresponding to the main shaft 202 which are provided on the roll shaft blocker 203; bolts pass through the plurality of locking threaded holes 241 and the plurality of locking through-holes 243, so that the roll shaft main body 201 and the roll shaft blockers 203 and 208 are locked and fixed; in order to guarantee a stability of a crushing device 2 when rotating, the plurality of locking threaded holes 241 are provided in regular triangle around the main shaft through-hole 207.

The crushing components comprise tools, axial interval adjusting blocks and radial supporting blocks, which match with the roll shaft convex bodies 204 and the roll shaft grooves 205, wherein: each tool consists of a tool base and a tool head which are fixedly connected; a tool base groove, corresponding to the roll shaft convex body 204, is provided on the tool base; and an axial interval adjusting block groove 214, corresponding to the roll shaft convex body 204, is provided on each axial interval adjusting block.

Figure 7:
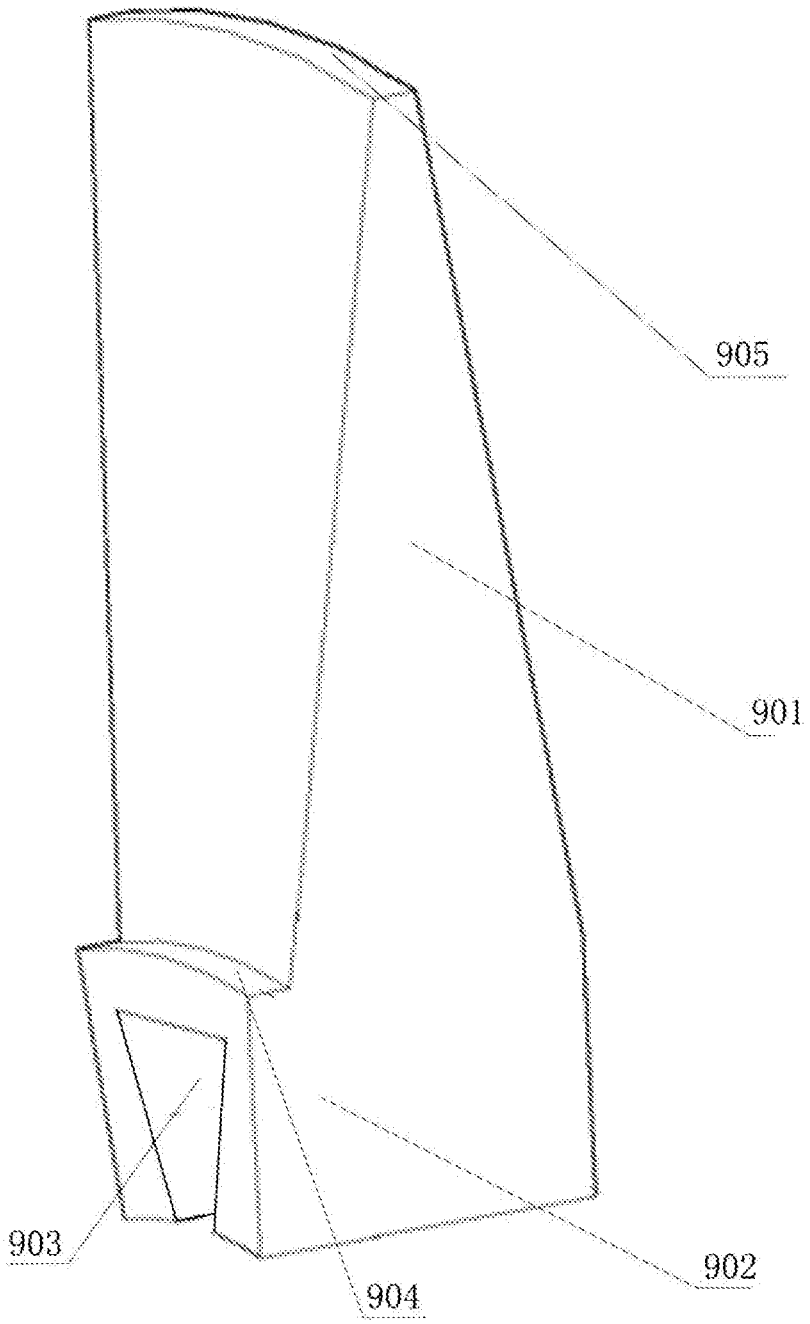
FIG. 7 is a structural sketch view of a radial supporting block according to the first preferred embodiment of the present invention.

As shown in FIG. 7, each radial supporting block consists of a supporting main body 901 and a supporting base 902, wherein: a supporting groove 903, corresponding to the roll shaft convex body 204, is provided on the supporting base 902; a supporting convex surface 904 is arranged at a side of a connection surface between the supporting main body 901 and the supporting base 902 along an axial direction of the supporting groove 903; and a top end 905 of the supporting main body is a curved surface.

The tools, the axial interval adjusting blocks and the radial supporting blocks are slidably engaged with the roll shaft convex bodies 204 along an axial direction of the main shaft 202.

The tools are divided into cutting tools and grinding tools, wherein: the cutting tools are higher than the grinding tools; for each cutting tool, symmetrical cutting convex surfaces 227 are arranged at two sides of a connection surface between a lower end surface of a cutting tool head 215 and an upper end surface of a cutting tool base 216 along an axial direction of a cutting tool base groove 217, and a top end 218 of the cutting tool head of the cutting tool is linear; for each grinding tool, a grinding convex surface 231 is arranged at a side of a connection surface between a lower end surface of a grinding tool head 219 and an upper end surface of a grinding tool base 220 along an axial direction of a grinding tool base groove 221, and a top end of the grinding tool head of the grinding tool is a curved surface.

When cutting the waste tire, the cutting tools and the grinding tools can be used independently or used together. When grinding the waste tire, only the grinding tools are used; a side of the grinding tool head 219 of each grinding tool, where no grinding convex surface 231 is arranged along the grinding tool base groove 221, is a grinding surface; when grinding, the grinding surfaces of the adjacent grinding tools contact to form the grinding grooves, so as to grind the waste tire; the radial supporting blocks are arranged on the adjacent roll shaft convex bodies, and the supporting convex surfaces 904 of the adjacent radial supporting blocks contact to form the supporting grooves, playing a role of transportation channel for the ground waste tire, so that the ground waste tire moves between the grinding grooves and the supporting grooves alternately, thereby decreasing the heat generated during the grinding process.

When cutting or grinding the waste tire, the axial interval adjusting blocks can be arranged between the adjacent cutting tools, grinding tools and radial supporting blocks along an axial direction of the roll shaft according to actual working conditions, for interval adjustment.

The multi-functional crusher with the crushing device comprises a box 1, the crushing device 2, and a recovery device 3, wherein: a crushing cavity 104 for placing the waste tire is provided inside the box 1; a material inlet 101 is provided on a top plate of the box, corresponding to the crushing cavity 104; the waste tire enters the crushing cavity 104 through the material inlet 101; a feed plate 103 is arranged at the material inlet 101 in a certain angle, which facilitates feeding; a material outlet 102 is also provided on the top plate of the box 1, for discharging crushed debris; and the top plate of the box, where the material outlet 102 is located, is a filleting top plate 105 with dense filtering through-holes provided thereon.

The main shaft 202 passes through a front plate 115 and a back plate 116 of the box 1, for arranging the crushing device 2 on a common frame body outside the box 1; the crushing device 2 is driven through a drive mechanism and rotates around the main shaft 202; the drive mechanism is preferred to be a motor 206 assembled on the main shaft 202; the front plate 115 and the back plate 116 of the box are higher than the top plate of the box, for blocking the waste tire put into the material inlet 101 and the crushed debris at the material outlet 102; the front plate 115 and the back plate 116 of the box are detachably connected to the box 1.

The recovery device 3 comprises a recovery component and a recovery pushing mechanism at the material outlet 102, wherein: the recovery pushing mechanism comprises a recovery pushing plate 302 and a recovery pushing part 303 arranged on the recovery pushing plate 302; the recovery pushing plate 302 is slidably connected to a side plate 117 of the box, and the side plate is arranged at a side of the material outlet 102; a discharge port 304, corresponding to the recovery pushing mechanism, is provided at an upper part of the front plate 115 of the box, so as to push the crushed debris out of the box from the discharge port 304; and the recovery pushing part 303 is preferred to be a hydraulic part.

The recovery component comprises an upper axial blocker 305 detachably connected to the top plate of the box and a lower axial blocker 306 detachably connected to a bottom plate of the box, wherein: the upper axial blocker 305 and the lower axial blocker 306 are engaged with the crushing components; the upper axial blocker 305 and a first end of the material outlet 102 are connected to an upper recovery plate 307; the lower axial blocker 306 and a second end of the material outlet 102 are connected to a lower recovery plate 308; and the upper recovery plate 307 protrudes from the material outlet 102, so as to avoid an outflow of the debris during the discharge process.

A crushing pushing mechanism and a material inlet cover mechanism are arranged at the material inlet 101, wherein: the crushing pushing mechanism comprises a crushing pushing plate 212, which is slidably connected to the front plate 115 and the back plate 116 of the box, and a crushing pushing part 213 arranged on the crushing pushing plate 212; the material inlet cover mechanism comprises a cover plate 209, which is slidably connected to the front plate 115 and the back plate 116 of the box, and a cover pushing part 210 arranged on the cover plate 209; and, the cover pushing part 210 and the crushing pushing part 213 are both preferred to be hydraulic parts.

The multi-functional crusher further comprises a cooling medium mechanism, wherein: the cooling medium mechanism comprises a cooling medium through-hole 401 provided on the front plate 115 of the box, through which a cooling medium enters the box, a front reflux groove 402 arranged on the front plate 115 of the box, a back reflux groove 412 arranged on the back plate 116 of the box, and a filtering cavity 403; the filtering cavity is an enclosed cavity formed by the filtering top plate 105, the side plate 117 of the box, the bottom plate of the box, the lower recovery plate 308 and the lower axial blocker 306; a first end of the front reflux groove 402 is interconnected to the filtering cavity 403 through a first through-hole, and a second end of the front reflux groove 402 is interconnected to the crushing cavity 104 through a second through-hole, so as to recycle the cooling medium; the first through-hole and the second through-hole are both provided on a connection surface between the front plate 115 of the box and the front reflux groove 402; the connection way of the back reflux groove 412 to the filtering cavity 403 and the crushing cavity 104 is same as that of the front reflux groove 402, and is not repeated herein.

According to the present invention, an implementation method of the multi-functional crusher comprises steps of:

(1) selecting the plurality of roll shaft convex bodies on the roll shaft main body, and assembling the crushing components thereon; and, according to actual requirements, arranging the cutting tools, the grinding tools, the radial supporting blocks, and the axial interval adjusting blocks;

(2) arranging the crushing device inside the box; and introducing a certain volume of cooling medium into the box through the cooling medium through-hole 401;

(3) putting a certain amount of waste tire into the box through the material inlet 101; and pushing the cover plate 209 by the cover pushing part 210, so that the cover plate 209 covers the material inlet 101 and the relatively enclosed crushing cavity 104 is formed;

(4) starting the motor 206, and pushing the crushing pushing plate 212 by the crushing pushing part 213, so that the waste tire moves towards the crushing device;

(5) cutting the waste tire into strips or blocks by the cutting tools; and continuously grinding the waste tire, obtained after cutting, between the intervals of the crushing components by the grinding tools;

(6) under an effect of rotational centrifugal force of the crushing device 2, by the ground debris, entering a channel among the material outlet 102, the upper recovery plate 307 and the lower recovery plate 308 through a fit clearance between the lower axial blocker 306 and the tools, and being gradually accumulated on the filtering top plate 105;

(7) pushing the recovery pushing plate 302 by the recovery pushing part 303, so as to push the crushed debris out of the box 1 from the discharge port 304; wherein: during the process, the cooling medium in the debris is gradually accumulated in the filtering cavity 403 through the filtering through-holes on the filtering top plate 105, and then returns to the crushing cavity 104 through the front reflux groove 402 and the back reflux groove 412, which circulates continuously; and (8) during the crushing process of the waste tire, recovering the cover plate 209, the cover pushing part 210, the crushing pushing plate 212, the crushing pushing part 213, the recovery pushing plate 302 and the recovery pushing part 303 to original positions, and repeating the steps of (3)-(7), so as to realize an automatic cycle operation.

When cutting the waste tire into blocks, the lower axial blocker 306 and the upper axial blocker 305 are removed from the box 1; according to width requirements of waste tire cutting, the tools, the radial supporting blocks and the axial interval adjusting blocks, conforming to the cutting requirements, are assembled on the roll shaft convex bodies; the detailed working process is same as the above steps and not repeated herein.

Furthermore, the crushing solid can be cut or ground with the cutting tools or the grinding tools independently.

Second Preferred Embodiment

Figure 8:
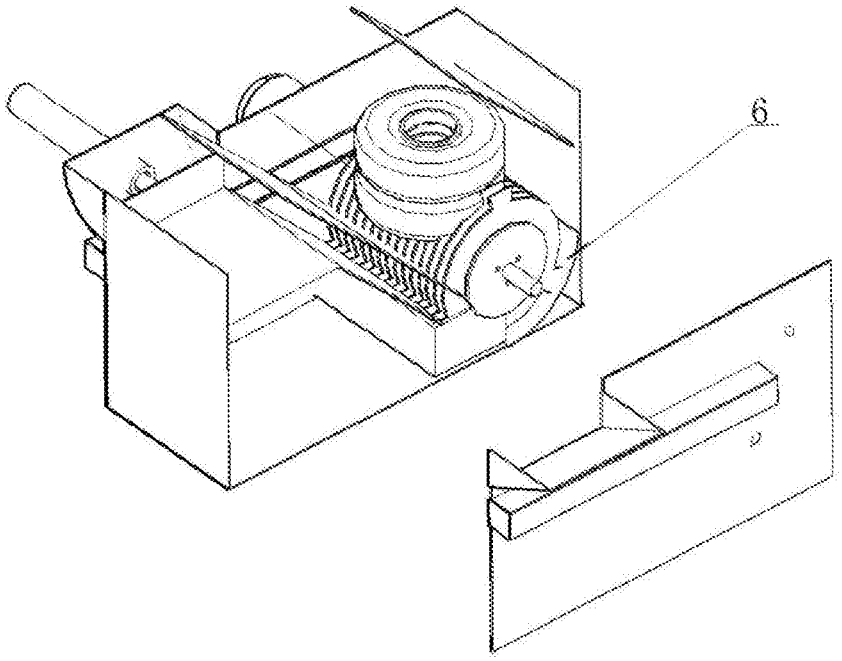
FIG. 8 is a structural sketch view of a multi-functional crusher according to a second preferred embodiment of the present invention.

As shown in FIG. 8, according to the second preferred embodiment, a multi-functional crusher is provided. The multi-functional crusher in the second preferred embodiment is different from the multi-functional crusher in the first preferred embodiment in that: the crushing pushing mechanism, the material inlet cover mechanism, and the upper axial blocker 305 are removed; in addition, the top plate 125 between the material inlet 101 and the material outlet 102 is removed; and an arc-shaped baffle 6 is added at a side of the crushing device in the box, for pushing the crushed waste tire to the lower axial blocker and reducing a manufacturing difficulty of the crusher.

An implementation method of the multi-functional crusher comprises steps of:

(1) selecting the plurality of roll shaft convex bodies on the roll shaft main body, and assembling the crushing components thereon; and, according to actual requirements, arranging the cutting tools, the grinding tools, the radial supporting blocks, and the axial interval adjusting blocks;

(2) arranging the crushing device inside the box; and introducing a certain volume of cooling medium into the box through the cooling medium through-hole;

(3) starting the motor;

(4) putting the waste tire into the box through the material inlet;

(5) cutting the waste tire into strips or blocks by the cutting tools; and continuously grinding the waste tire, obtained after cutting, between the intervals of the crushing components by the grinding tools;

(6) under an effect of rotational centrifugal force of the crushing device, by the ground debris, firstly passing through the arc-shaped baffle 6, then entering a channel among the material outlet, the upper recovery plate and the lower recovery plate through a fit clearance between the lower axial blocker and the tools, and being gradually accumulated on the filtering top plate;

(7) pushing the recovery pushing plate by the recovery pushing part, so as to push the crushed debris out of the box from the discharge port; wherein: during the process, the cooling medium in the debris is gradually accumulated in the filtering cavity through the filtering through-holes on the filtering top plate, and then returns to the crushing cavity through the front reflux groove and the back reflux groove, which circulates continuously; and (8) during the crushing process of the waste tire, recovering the recovery pushing plate and the recovery pushing part to original positions, and repeating the steps of (4)-(7), so as to realize an automatic cycle operation.

The crusher in the second preferred embodiment is suitable for processing the relatively heavy big waste tire and other solid materials, and can conduct the crushing operation continuously.

Third Preferred Embodiment

Figure 9:
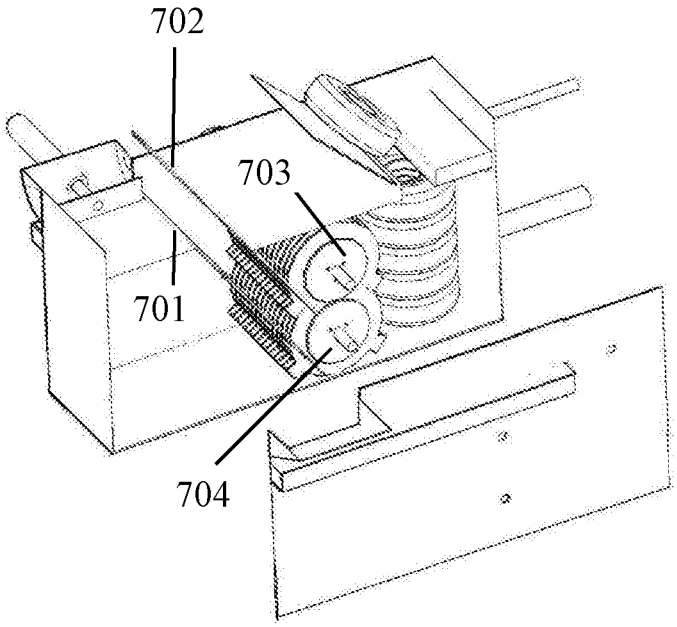
FIG. 9 is a structural sketch view of a multi-functional crusher according to a third preferred embodiment of the present invention.

As shown in FIG. 9, according to the third preferred embodiment, a multi-functional crusher is provided. The multi-functional crusher in the third preferred embodiment is different from the multi-functional crusher in the first preferred embodiment in that: an upper crushing device 703 and a lower crushing device 704, which are engaged with each other, are arranged; a lower end of the upper crushing device 703 and the material outlet are connected to an upper recovery plate 702; the upper recovery plate 702 protrudes from the top plate of the box; the upper recovery plate 702 is engaged with the crushing components of the upper crushing device 703; the lower crushing device 704 and the bottom plate of the box are connected to a lower recovery plate 701; and the lower recovery plate 701 is engaged with the crushing components of the lower crushing device 704.

The implementation method of the crusher in the third preferred embodiment is same as that in the first preferred embodiment.

Fourth Preferred Embodiment

Figure 10:
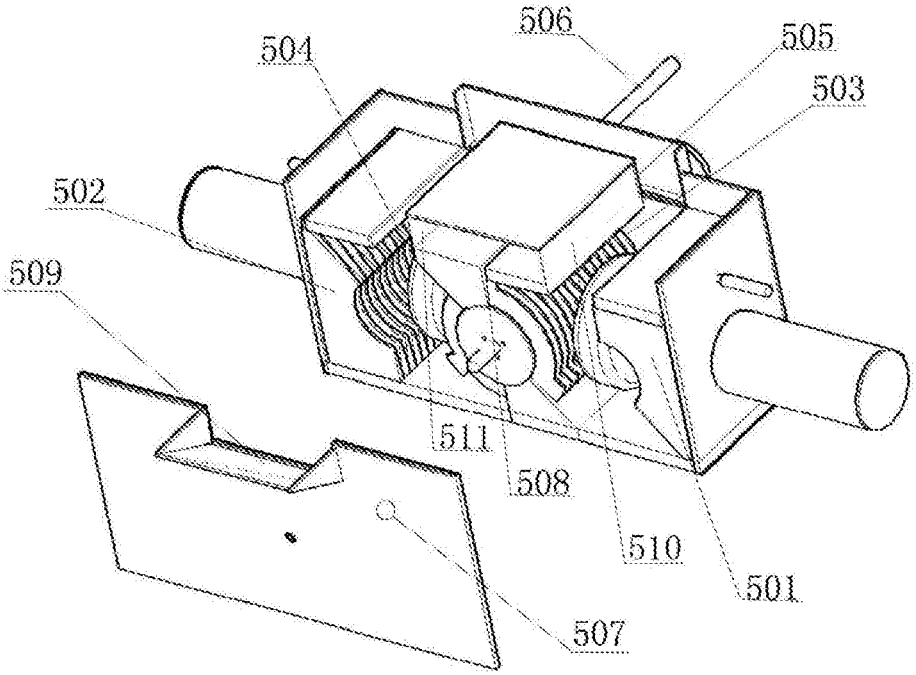
FIG. 10 is a structural sketch view of a multi-functional crusher according to a fourth preferred embodiment of the present invention.

As shown in FIG. 10, according to the fourth preferred embodiment, a multi-functional crusher is provided. The multi-functional crusher in the fourth preferred embodiment is different from the multi-functional crusher in the first preferred embodiment in that: the crushing pushing mechanism and the material inlet cover mechanism are arranged on both two side plates of the box; the recovery component and the cooling medium mechanism are removed; the crushing pushing plate in the original crushing pushing mechanism is replaced by the crushing pushing seats, respectively a first crushing pushing seat 501 and a second crushing pushing seat 502; and grooves are provided on the first crushing pushing seat 501 and the second crushing pushing seat 502, for being engaged with the crushing components.

Furthermore, the recovery device is different and arranged above the crushing device, comprising a recovery box and a recovery pushing mechanism arranged at a back side of the recovery box, wherein: a material outlet 508 is provided at a middle part of a bottom surface of the recovery box; material inlets 503 and 504 are respectively provided at side plates 510 and 511 of the recovery box; both of the side plates 510 and 511 of the recovery box are filtering plates with filtering holes provided thereon; the recovery pushing mechanism comprises a recovery pushing plate 505, which is slidably connected to the side plates 510 and 511 of the recovery box, and a recovery pushing part 506 arranged on the recovery pushing plate; and a discharge port 509, corresponding to the recovery pushing mechanism, is provided at the upper part of the front plate of the box.

An implementation method of the multi-functional crusher comprises steps of:

(1) selecting the plurality of roll shaft convex bodies on the roll shaft main body, and assembling the crushing components thereon; and, according to actual requirements, arranging the cutting tools, the grinding tools, the radial supporting blocks, and the axial interval adjusting blocks;

(2) injecting a certain volume of cooling medium into the box through a cooling medium through-hole 507 provided on the front plate of the box;

(3) putting a certain amount of waste tire into the box through the material inlets 503 and 504; and pushing the corresponding cover plates respectively by the cover pushing parts at the two sides, so that the cover plates cover the material inlets 503 and 504 and the relatively enclosed crushing cavity is formed;

(4) pushing the corresponding crushing pushing plates respectively by the two crushing pushing parts, so as to crush the waste tire;

(5) the crushed tire being gradually accumulated in the recovery box along the material outlet 508; a part of the injected cooling medium returning to the box along the material outlet 508, and the other part of the injected cooling medium passing through the filtering plates at the two sides of the recovery box and returning to the box along the grooves on the crushing pushing seats, so as to realize continuous circulation of the cooling medium;

(6) pushing the recovery pushing plate 505 by the recovery pushing part 506, so as to push the crushed debris out of the box from the discharge port 509; and (7) recovering the crushing pushing mechanisms and the material inlet cover mechanisms, which are arranged at the two sides of the box, and the recovery pushing mechanism to original positions, and repeating the steps of (3)-(6), so as to realize a continuous cycle operation.

The technical solutions of the present invention are further described with the above preferred embodiment, but the protection scope of the present invention is not limited thereto. Equivalent modifications and changes made by one of ordinary skill in the art without departing from the spirit and range of the present invention should be all encompassed in the protection scope of the present invention.

What is claimed is:

1. A crushing device for a waste tire, comprising a roll shaft and crushing components arranged on the roll shaft, wherein: the roll shaft comprises a main shaft, a roll shaft main body fixedly arranged on the main shaft, and roll shaft blockers arranged at two axial ends of the main shaft; a plurality of roll shaft convex bodies are arranged on a periphery of the roll shaft main body along a circumferential direction; and a roll shaft groove is formed between each two adjacent roll shaft convex bodies;

the crushing components comprise tools, axial interval adjusting blocks and/or radial supporting blocks, wherein: each tool consists of a tool base and a tool head which are fixedly connected, and a tool base groove, corresponding to the roll shaft convex body, is provided on the tool base; the tools are cutting tools and/or grinding tools; symmetrical cutting convex surfaces are arranged at a connection surface between a tool base and a tool head of each cutting tool along an axial direction of a cutting tool base groove; and a grinding convex surface is arranged at a side of a connection surface between a tool base and a tool head of each grinding tool along an axial direction of a grinding tool base groove;

each radial supporting block consists of a supporting main body and a supporting base, wherein: a supporting groove, corresponding to the roll shaft convex body, is provided on the supporting base; and a supporting convex surface is arranged at a side of a connection surface between the supporting main body and the supporting base along an axial direction of the supporting groove; and an axial interval adjusting block groove, corresponding to the roll shaft convex body, is provided on each axial interval adjusting block; the tools, the radial supporting blocks, and the axial interval adjusting blocks are slidably engaged with the roll shaft convex bodies; and the roll shaft blockers and the crushing components are locked and fixed through locking structures.

2. The crushing device, as recited in claim 1, wherein: the locking structures comprise a plurality of locking threaded holes provided on two end surfaces of the roll shaft main body, a plurality of locking through-holes which are provided on the roll shaft blockers and correspond to the plurality of locking threaded holes, and main shaft through-holes provided on the roll shaft blockers, through which the main shaft passes; the crushing components and the roll shaft blockers are locked and fixed through bolts.

3. A multi-functional crusher, comprising a box, a recovery device and the crushing device as recited in claim 1, wherein: a material inlet and a material outlet are provided at an upper part of the box; the crushing device is arranged on a common frame body outside the box through the main shaft and is driven through a drive mechanism; the recovery device comprises a recovery component arranged inside the box and a recovery pushing mechanism arranged at the material outlet; the recovery pushing mechanism comprises a recovery pushing plate and a recovery pushing part arranged on the recovery pushing plate; the recovery pushing plate is slidably connected to a first side plate of the box at the material outlet; and a discharge port, corresponding to the recovery pushing plate, is provided at an upper part of a front plate or a back plate of the box.

4. The multi-functional crusher, as recited in claim 3, further comprising a cooling medium mechanism, wherein: the cooling medium mechanism comprises a cooling medium through-hole, a reflux groove and a filtering cavity; the cooling medium through-hole is provided on the front plate or the back plate of the box; the reflux groove is provided on the front plate and/or the back plate of the box; the filtering cavity is arranged below a filtering top plate at the material outlet; a first end of the reflux groove is interconnected to the filtering cavity through a first through-hole, and a second end of the reflux groove is interconnected to a crushing cavity for placing a waste tire through a second through-hole; and the first through-hole and the second through-hole are both provided on a connection surface between the reflux groove and the front plate or the back plate of the box.

5. The multi-functional crusher, as recited in claim 4, wherein: a crushing pushing mechanism and a material inlet cover mechanism are arranged on a second side plate of the box at the material inlet; the crushing pushing mechanism comprises a crushing pushing plate and a crushing pushing part arranged on the crushing pushing plate; the material inlet cover mechanism comprises a cover plate for covering the material inlet and a cover pushing part arranged on the cover plate; the crushing pushing plate and the cover plate are both slidably connected to the front plate and the back plate of the box.

6. The multi-functional crusher, as recited in claim 3, wherein: the recovery component comprises a lower axial blocker detachably connected to a bottom plate of the box; the lower axial blocker is engaged with the crushing components; the lower axial blocker and a first end of the material outlet are connected to a lower recovery plate.

7. The multi-functional crusher, as recited in claim 6, wherein: the recovery component further comprises an upper axial blocker detachably connected to a top plate of the box; the upper axial blocker is engaged with the crushing components; the upper axial blocker and a second end of the material outlet are connected to an upper recovery plate.

8. The multi-functional crusher, as recited in claim 7, wherein: a crushing pushing mechanism and a material inlet cover mechanism are arranged on a second side plate of the box at the material inlet; the crushing pushing mechanism comprises a crushing pushing plate and a crushing pushing part arranged on the crushing pushing plate; the material inlet cover mechanism comprises a cover plate for covering the material inlet and a cover pushing part arranged on the cover plate; the crushing pushing plate and the cover plate are both slidably connected to the front plate and the back plate of the box.

9. The multi-functional crusher, as recited in claim 6, wherein: a crushing pushing mechanism and a material inlet cover mechanism are arranged on a second side plate of the box at the material inlet; the crushing pushing mechanism comprises a crushing pushing plate and a crushing pushing part arranged on the crushing pushing plate; the material inlet cover mechanism comprises a cover plate for covering the material inlet and a cover pushing part arranged on the cover plate; the crushing pushing plate and the cover plate are both slidably connected to the front plate and the back plate of the box.

10. The multi-functional crusher, as recited in claim 3, wherein: the recovery component comprises an upper recovery plate and a lower recovery plate which are connected to the material outlet; the upper recovery plate and the lower recovery plate are both engaged with the crushing components.

11. The multi-functional crusher, as recited in claim 10, wherein: a crushing pushing mechanism and a material inlet cover mechanism are arranged on a second side plate of the box at the material inlet; the crushing pushing mechanism comprises a crushing pushing plate and a crushing pushing part arranged on the crushing pushing plate; the material inlet cover mechanism comprises a cover plate for covering the material inlet and a cover pushing part arranged on the cover plate; the crushing pushing plate and the cover plate are both slidably connected to the front plate and the back plate of the box.

12. The multi-functional crusher, as recited in claim 3, wherein: a crushing pushing mechanism and a material inlet cover mechanism are arranged on a second side plate of the box at the material inlet; the crushing pushing mechanism comprises a crushing pushing plate and a crushing pushing part arranged on the crushing pushing plate; the material inlet cover mechanism comprises a cover plate for covering the material inlet and a cover pushing part arranged on the cover plate; the crushing pushing plate and the cover plate are both slidably connected to the front plate and the back plate of the box.

13. A multi-functional crusher, comprising a box, a recovery device and the crushing device as recited in claim 1, wherein: material inlets and a material outlet are provided at an upper part of the box; the crushing device is arranged on a common frame body outside the box through the main shaft; the recovery device is arranged above the crushing device, comprising a recovery box and a recovery pushing mechanism; the material outlet is provided at a middle part of a bottom surface of the recovery box; the material inlets are provided at two side plates of the recovery box; the recovery pushing mechanism comprises a recovery pushing plate and a recovery pushing part arranged on the recovery pushing plate; the recovery pushing plate is slidably connected to the side plates of the recovery box; and a discharge port, corresponding to the recovery pushing plate, is provided on a front plate or a back plate of the box.

14. The multi-functional crusher, as recited in claim 13, wherein: crushing pushing mechanisms and material inlet cover mechanisms are arranged on the both two side plates of the box; each crushing pushing mechanism comprises a crushing pushing seat and a crushing pushing part arranged on the crushing pushing seat; each material inlet cover mechanism comprises a cover plate and a cover pushing part arranged on the cover plate; the crushing pushing seats and the cover plates are all slidably connected to the front plate and the back plate of the box; and the crushing pushing seats are engaged with the crushing components.

* * * * *